United States Patent [19]

Fischer

[11] Patent Number: 4,920,706

[45] Date of Patent: May 1, 1990

[54] PNEUMATICALLY INFLATABLE ROOF SEAL

[75] Inventor: William H. Fischer, New Milford, Conn.

[73] Assignee: The Presray Corporation, Pawling, N.Y.

[21] Appl. No.: 247,358

[22] Filed: Sep. 21, 1988

[51] Int. Cl.[5] ..... E04H 15/20

[52] U.S. Cl. ..... 52/2 B; 52/2 A; 52/2 J

[58] Field of Search ..... 52/2 A, 2 B, 2 C, 393, 52/2 J

[56] References Cited

U.S. PATENT DOCUMENTS

| | | | |
|---|---|---|---|
| 1,733,034 | 10/1929 | Tufenkjian | 52/2 J X |
| 2,850,026 | 9/1958 | Leatherman | 52/2 J |
| 2,990,837 | 7/1961 | Cushman | 52/2 J |
| 3,030,640 | 4/1962 | Gosman | 52/2 J X |
| 3,086,753 | 4/1963 | Cushman | 52/2 J X |
| 3,601,935 | 8/1971 | Cadwell | 52/393 X |
| 3,973,363 | 8/1976 | LaPorte et al. | 52/2 J |
| 4,257,199 | 3/1981 | Kuboyama | 52/2 J |

FOREIGN PATENT DOCUMENTS

| | | | |
|---|---|---|---|
| 440584 | 12/1967 | Switzerland | 52/2 J |

*Primary Examiner*—David A. Scherbel
*Assistant Examiner*—Lan Mai
*Attorney, Agent, or Firm*—Schweitzer & Cornman

[57] ABSTRACT

An inflatable pneumatic seal is provided for very large structures, such as domed stadiums provided with retractable roof structures. Because of the necessarily large cross sectional configuration, required for closing large designed clearances in stadium roof sections, the cross section of the seal must be maintained under control during non-working periods. A structure is provided which is pressurized to one cross sectional configuration for closing and sealing purposes and pressurized to a second cross sectional configuration for maintaining cross sectional control during periods when the seal is inactive.

6 Claims, 2 Drawing Sheets

24758

PNEUMATICALLY INFLATABLE ROOF SEAL

BACKGROUND AND SUMMARY OF THE INVENTION

Large stadium structures are currently being designed with rigid dome or roof structures comprised of movable elements that are retractable to provide for open air events in clement weather but can be closed and made weather-tight when desired. Because of design and/or construction constraints, it is typical to provide gaps of significant dimension between adjacent, rigid roof sections, when the sections are in their "closed" configuration. In order to make the structure weather-tight, it has been proposed to utilize inflatable pneumatic seals, which are expandable under internal pneumatic pressure to close and seal the gap between adjacent roof sections.

In a representative stadium roof design, gaps between adjacent rigid roof sections may be as much as 16 inches or greater, and may extend over a length of, for example, 600 or 700 feet. A pneumatic seal for bridging and closing such a gap must of necessity have a very large cross section when fully pressurized. This is turn gives rise to significant problems when the seal is depressurized, because the unit (at least one of conventional design) loses structural stability and can be unpredictably distorted by wind, for example, or portions of the seal may be improperly positioned so as to interfere with proper inflating and sealing and/or be subject to possible damage.

In accordance with the present invention, a novel and improved large scale inflatable pneumatic seal is provided which is formed with primary and secondary internal chamber structuring, forming in essence primary and secondary chamber areas which are separately inflatable. When the primary chamber of the seal is inflated, the seal is caused to assume a desired shape for bridging the gap and forming a weather-tight seal between adjacent rigid roof sections. When the primary chamber is depressurized, to deactivate the seal between roof sections, the seal is caused to assume a second, positively controlled configuration, by increasing the level of pressurization of the secondary chamber. In this manner, a pneumatic seal of very large cross section, and substantial length is maintained under effective physical control at all times.

In the construction of a typical sealing element according to the invention, the secondary chamber is comprised of a plurality of subchambers, so that during pressurization of the secondary chamber, the cross sectional configuration of the seal is relatively thin in the sealing direction and relatively wide in the nonsealing direction. When the primary chamber is inflated, the seal assumes a somewhat oval cross sectional configuration, enabling it to bridge and seal a wide and variable gap between adjacent roof sections.

In a particularly advantageous form of the invention, the secondary chamber may be maintained continuously under a relatively low positive pneumatic pressure. The primary chamber, which is periodically pressurized to effect closing and sealing and depressurized for opening and retracting, is inflated to a somewhat higher pressure than the secondary chamber. Accordingly, when the primary chamber is pressurized for sealing, the secondary chamber is partially collapsed under the effect of the greater pressure surrounding it, within the primary chamber.

Most advantageously, for sealing elements of very great length, such as will be typical for stadium roof seals, the seals can be manufactured in modular sections. Each such section, according to the invention, is provided with a self-contained, sealed secondary chamber. The individual modules are then sealed end to end during installation so as to provide, in the installed unit, a primary chamber of continuous length enclosing a plurality of separate secondary chambers.

For a more complete understanding of the above and other features and advantages of the invention, reference should be made to the following detailed description of a preferred embodiment and to the accompanying drawings.

DESCRIPTION OF PREFERRED EMBODIMENT

Figure 2:
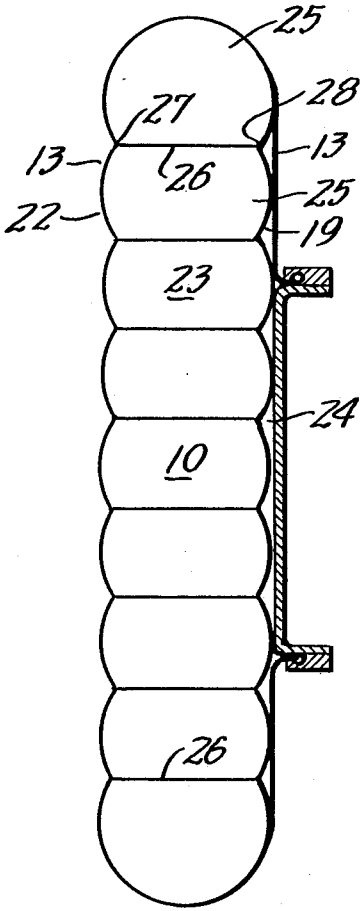
FIG. 2 is a cross sectional view of the inflatable seal of FIG. 1, in a "retracted" configuration.
Figure 1:
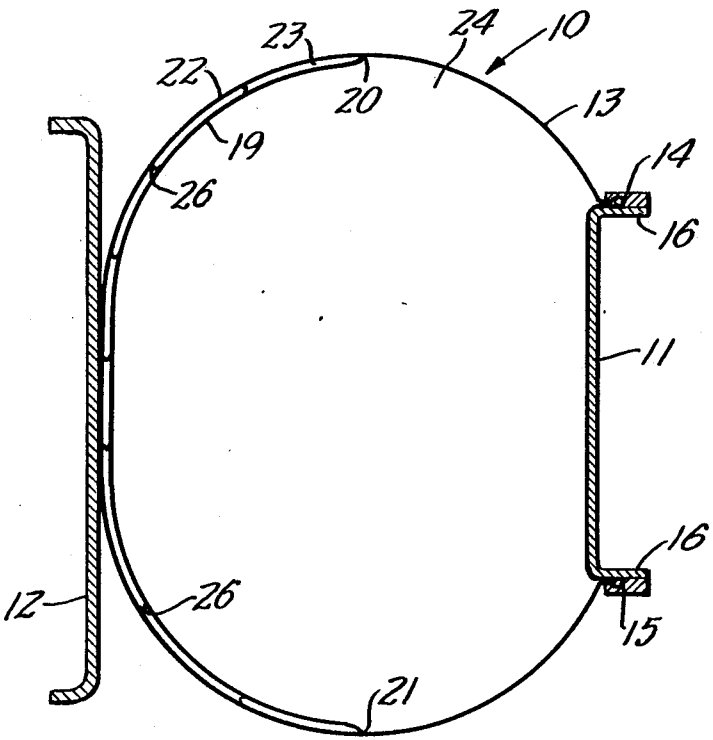
FIG. 1 is a fragmentary cross sectional view illustrating the inflatable pneumatic seal of the invention, shown in bridging, sealing relation between adjacent sections of a structure, such as a stadium roof.

Referring now to the drawing, and initially to FIGS. 1 and 2, the reference numeral 10 designates generally an inflatable pneumatic sealing element, especially for use in connection with the sealing of sectional roofs for domed stadiums and the like. Such seals may be designed to bridge and seal a gap of, for example, up to about 25 inches in width, over a lengthwise span of perhaps 600–700 feet. In the illustration of FIG. 1, the reference numeral 11 designates a structural channel element forming the lateral side edge of one roof section, while the reference numeral 12 designates a structural channel element forming the lateral side edge of the adjacent roof section. The seal 10 of FIG. 1 is shown in its active, inflated condition, bridging the space between the side members 11, 12 and forming a weather-tight seal therebetween.

Pursuant to the invention, the inflatable seal 10 includes an elongated tubular wall membrane 13, formed of a suitable reinforced flexible material. Typically, material for this purpose is a neoprene/hypalon elastomer, with an embedded reinforcement of a suitably woven fabric. In the example seal, suitable for a domed stadium, the overall "circumference" or peripheral dimension of the flexible tubular wall 13 may be on the order of 110–120 inches, for example. In accordance with one aspect of the invention, the sealing elements are constructed in modular sections of predetermined length, such as 75–100 feet. This enables the sections to be kept at a reasonable and manageable size and weight for handling and installation. The individual sections are arranged to be joined end to end as a field installation procedure, in order to construct a continuous inflatable seal for the full length of the gap to be closed.

Figure 3:
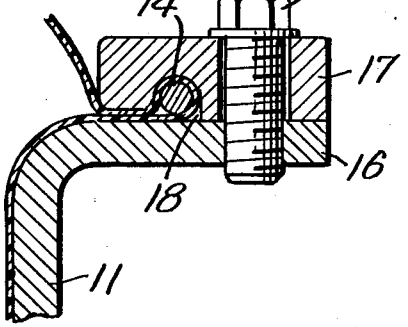
FIG. 3 is an enlarged, fragmentary cross sectional view illustrating details of the mounting of the inflatable seal element to the structure to be sealed.

To advantage, girts with rope beads 14 and 15 (see FIG. 3) running the full length of the modular sections, are incorporated in the interior wall of the tube 13, extending in parallel relation a predetermined distance apart. As reflected in FIGS. 1 and 3, the beads 14 and 15 form an advantageous arrangement for clamping of the pneumatic element to one of the channel members 11 at widely spaced points, preferably at the flanges 16 of the channel. For this purpose, clamping strips 17, provided with longitudinally extending recesses 18 for reception of the cords 14, 15, are secured to the flanges 16 by means of bolts 18.

In accordance with the invention, the large flexible tube 13 forms a primary inflatable chamber. Within the primary chamber, there is formed a secondary chamber which comprises in part a flexible wall 19 bonded at its opposite side edges 20, 21 to the interior wall of the primary tube 13. The illustrated wall 19 of the inner chamber extends for approximately one half of the overall circumference of the primary tubular wall 13, although this distance may be varied. The interior wall 19 forms, together with the outer portion 22 of the primary tubular wall, a separate chamber 23 which, for descriptive purposes, can be referred to as a secondary chamber. The remaining interior portion 24 of the principal tubular structure may be considered for descriptive purposes as a primary chamber.

As particularly shown in FIG. 2, but also visible in FIG. 1, the secondary chamber 23 is divided into a plurality of communicating subchambers 25 by means of connecting web sections 26. Each of the web sections 26 is attached along one lateral edge 27 to the outer portion 22 of the main tubular wall 13, while the opposite lateral edge 28 is attached to the chamber forming wall 19. The connecting webs 26 are provided with through openings (not shown) for providing fluid communication among the various subchambers 25, so that the entire secondary chamber 23 may readily be maintained under a common pressure.

As reflected in FIG. 2, the connecting webs 26 are of a limited width (in the direction extending between the surfaces 11, 12 to be sealed) such that, when the secondary chamber 23 is inflated, and the primary chamber 24 is depressurized, the inflated configuration of the secondary chamber will be substantially as shown in FIG. 2, which represents the inflatable seal in its "retracted" condition. In the retracted condition, the overall width of the seal may be on the order of 8 inches, for example, while its vertical height may be increase significantly to, for example, 45 inches or so. For this purpose, the effective width of the connecting webs 26 may be on the order of 6 inches.

In accordance with basic concepts of the present invention, when it is desired to employ the inflatable seal for closing and securing the gap between channel plates 11, 12, the primary chamber 24 is pressurized. This causes the entire principal tubular structure 13 to seek a generally cylindrical shape, restricted, however, by the securement of the mounting beads 14, 15, and by the limiting constriction constituted by the channel 12. For most purposes, relatively low internal pressure is adequate to insure a highly effective seal with the face of the channel 12.

For controlled retraction of the seal, the primary chamber 24 is depressurized while the secondary chamber 23 is caused to be under a positive pressure. This causes the secondary chamber 23 to become expanded. As a result, the secondary chamber 23 tends to assume a generally straight, vertical configuration, rather than the oval configuration of FIG. 1, causing the entire outer tubular wall 13 to be maintained under circumferential tension, and the vertically elongated, narrow retracted configuration of the seal to be firmly and effectively maintained.

In a particularly advantageous form of the invention, the secondary chamber 23 may be maintained continuously pressurized, although at a pressure considerably less than that used for pressurization of the primary chamber 24 for bridging and sealing of the gap between adjacent roof sections. For example effective cross sectional control of the inflatable element 10 having dimensions of the type described may be accomplished utilizing a pressurization of about $\frac{1}{4}$ to about $\frac{1}{2}$ psi in the secondary chamber 23. For effective weather-tight sealing between roof sections, the primary chamber 24 may typically be inflated to a pressure of, say, 1 psi. The relatively greater pressure existing within the primary chamber 24 will partially collapse the secondary chamber 23, until the interior of the secondary chamber reaches pressure equilibrium with the primary chamber. In many cases, this is sufficient to allow the sealing element to be expanded sufficiently to form an effective seal. If necessary or desirable, of course, the secondary chamber can be depressurized for added flexibility of configuration of the seal as a whole.

Figure 4:
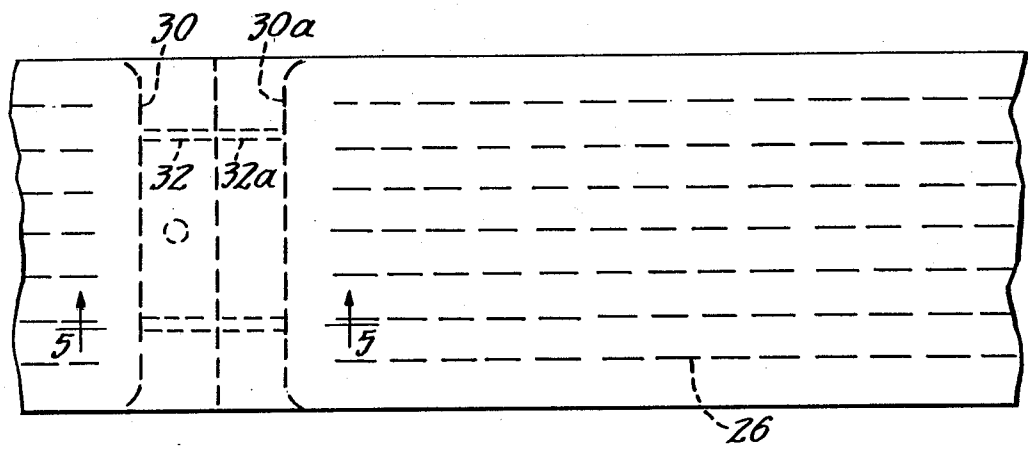
FIG. 4 is a fragmentary top plan view showing two modular sections of pneumatic sealing element according to the invention, joined together in end to end relation.
Figure 5:
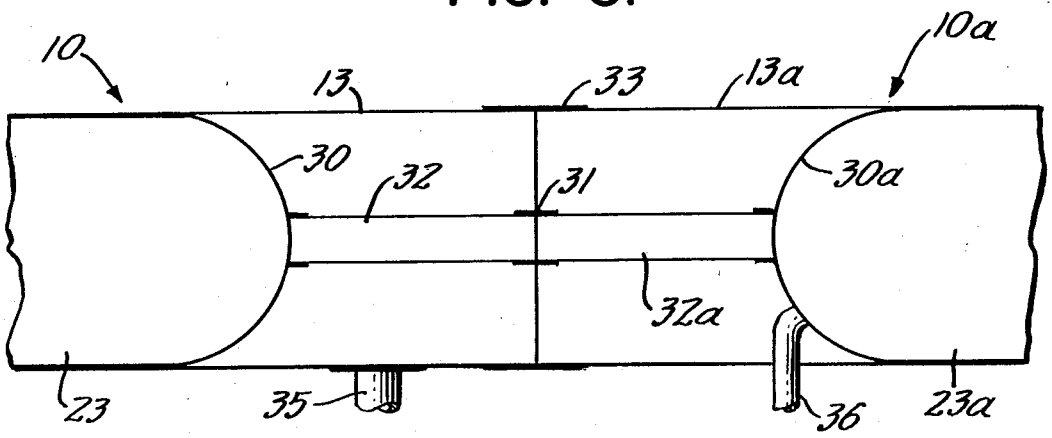
FIG. 5 is an enlarged, fragmentary cross sectional view as taken generally on line 5—5 of FIG. 4.

With reference to FIGS. 4 and 5, the reference numerals 13, 13*a* represent the primary tubular sections of adjacent modulars of finite length. End walls 30, 30*a* of respective secondary 23, 23*a* are sealed to the outer walls 13, 13*a* a short distance from the end extremities of the adjacent modular sections, designated generally by the reference numerals 10, 10*a*. A continuous sealing element is formed by providing a pair of field-installed joints. A first such joint 31 joins tubes 32, 32*a* connecting adjacent secondary 23, 23*a*. An outer joint 33 connects adjacent outer tubular walls 13, 13*a*. The modular sections may be of any convenient length, such as 75–100 feet, and a sufficient number of them may be connected end to end in the manner illustrated in FIGS. 4 and 5 to provide a continuous seal extending for the full length of the gap to be sealed.

Separate fluid inlet/outlet tubes 35,36 (FIG. 5) are powered to enable controllable pressurization and depressurization of the primary and secondary chambers.

The structure of the invention is uniquely advantageous for pneumatically inflatable seals of very large cross sectional configuration, as typically may be required in the sealing of removable roof structures for doomed stadiums, for example. The new seal structure provides for positive internal pressurization in both its "expanded" and "retracted" configurations, so that at all times there is sufficient form and rigidity to the flexible seal to provide substantially positive control over its shape and positioning.

As will readily be appreciated, the design of the internal, secondary chamber may be varied somewhat to help control the shape of the "retracted" configuration of the seal.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. A pneumatically inflatable seal especially for large structures, which comprises (a) a first elongated tubular element formed of a flexible membrane material, (b) a second elongated tubular element substantially coextensive with said first tubular element and secured thereto, (c) said secured tubular sections comprising a composite inflatable sealing structure, (d) means for controllably inflating and depressurizing said tubular elements, (e) said first tubular element, when pressurized, imparting a first cross-sectional configuration to said composite structure, expanded at least in a first predetermined direction, as for forming a seal, (f) said second tubular element, when pressurized, imparting a second cross sectional configuration to said composite structure, expanded in a second predetermined direction and correspondingly retracted in said first predetermined direction, as for controllably retaining said composite structure in a retracted condition, (g) said second tubular element being formed within said first tubular element.

2. A pneumatically inflatable seal according to claim 1, further characterized by (a) one of said tubular elements being formed with a plurality of longitudinally extending web sections connecting opposite side wall portions thereof and limiting expansion of the cross sectional configuration thereof under pressure to said first direction while accommodating expansion in said second direction.

3. A pneumatically inflatable seal according to claim 1, further characterized by (a) said second tubular element having a common wall with said first tubular element over a substantial portion of its circumference, and (b) said second tubular element, when inflated, imparting to said common wall a dimension in said second direction which is sufficiently large, in relation to the peripheral dimensions of said first tubular member, as to substantially restrict the ability of said first tubular element to expand in said first direction.

4. A pneumatically inflatable seal according to claim 3 further characterized by (a) said second tubular element being closed and sealed at each end, (b) said first tubular element being open at its ends and adapted for joining with a like tubular section in end-to-end relation.

5. A method of employing a pneumatically inflatable sealing element of claim 1, which comprises (a) continuously pressurizing said second elongated tubular element at a first, relatively low inflation pressure, and (b) periodically inflating said first tubular element to a pressure level sufficiently greater than said first mentioned pressure level to cause said composite structure to assume a cross sectional configuration determined principally by the pressurization of said first elongated tubular element.

6. A pneumatically inflatable seal especially for large structures, which comprises (a) a first elongated tubular element formed of a flexible membrane material, (b) a second elongated tubular element substantially coextensive with said first tubular element and secured thereto, (c) said secured tubular sections comprising a composite inflatable sealing structure, (d) means for controllably inflating and depressurizing said tubular elements, (e) said first tubular element, when pressurized, imparting a first cross-sectional configuration to said composite structure as for forming a seal, (f) said second tubular element, when pressurized, imparting a second cross sectional configuration to said composite structure, as for controllably retaining said composite structures in a retracted condition, (g) one of said elongated tubular elements being formed within the other.

* * * * *